US009228395B2

(12) United States Patent
Armstrong et al.

(10) Patent No.: US 9,228,395 B2
(45) Date of Patent: Jan. 5, 2016

(54) FLEXIBLE ROUTING DEVICE FOR WELL INTERVENTION

(71) Applicant: C6 Technologies AS, Stavanger (NO)

(72) Inventors: Kenny Armstrong, Stavanger (NO); Tore Aarsland, Nærbø (NO); Mats Bjørnenak, Kristiansand S (NO)

(73) Assignee: C6 TECHNOLOGIES AS, Stavanger (NO)

( * ) Notice: Subject to any disclaimer, the term of this patent is extended or adjusted under 35 U.S.C. 154(b) by 332 days.

(21) Appl. No.: 13/725,606

(22) Filed: Dec. 21, 2012

(65) Prior Publication Data

US 2013/0160988 A1 Jun. 27, 2013

Related U.S. Application Data

(60) Provisional application No. 61/580,098, filed on Dec. 23, 2011.

(30) Foreign Application Priority Data

Dec. 23, 2011 (NO) ..... 20111775

(51) Int. Cl.
*E21B 19/00* (2006.01)
*E21B 19/22* (2006.01)

(52) U.S. Cl.
CPC ..... *E21B 19/00* (2013.01); *E21B 19/22* (2013.01)

(58) Field of Classification Search
CPC ..... E21B 19/08; E21B 19/22; E21B 17/20; B66D 1/39
See application file for complete search history.

(56) References Cited

U.S. PATENT DOCUMENTS

| | | | | |
|---|---|---|---|---|
| 689,492 | A | 12/1901 | Hughes | |
| 2,453,038 | A * | 11/1948 | Rossmann | 166/75.11 |
| 2,810,439 | A | 10/1957 | McCullough et al. | |
| 2,892,535 | A * | 6/1959 | Cullen et al. | 226/173 |
| 3,479,067 | A * | 11/1969 | Potts | 285/261 |
| 3,524,606 | A | 8/1970 | Coski | |
| 3,563,436 | A * | 2/1971 | Reynard et al. | 226/173 |
| 3,646,798 | A * | 3/1972 | Alcock | 72/289 |
| 3,690,409 | A | 9/1972 | Brauss | |
| 4,091,867 | A * | 5/1978 | Shannon et al. | 166/77.3 |
| 4,099,403 | A * | 7/1978 | Alcock et al. | 72/288 |
| 4,125,162 | A * | 11/1978 | Groves et al. | 166/372 |
| 4,464,922 | A * | 8/1984 | Pamplin et al. | 72/286 |
| 4,492,363 | A | 1/1985 | Niskin | |

(Continued)

FOREIGN PATENT DOCUMENTS

| | | | |
|---|---|---|---|
| DE | 1170126 | B | 5/1964 |
| DE | 199 42 608 | A1 | 4/2001 |

(Continued)

*Primary Examiner* — Jennifer H Gay
(74) *Attorney, Agent, or Firm* — Birch, Stewart, Kolasch & Birch, LLP

(57) ABSTRACT

A conduit device for a petroleum well intervention string includes a first end connected to an intervention string drum unit with a drum and a second end connected to an injector head of a wellhead assembly. The conduit device, at any point between said first end and said second end, has a radius of curvature larger than or equal to a given smallest allowable radius of curvature for the intervention string. The conduit device forms a substantially incompressible fixed length path for the portion of said intervention string at any time present between the first end and the second end. The conduit device constitutes a tubular path for the intervention string.

14 Claims, 8 Drawing Sheets

(56) References Cited

U.S. PATENT DOCUMENTS

| | | | | |
|---|---|---|---|---|
| 4,947,665 | A * | 8/1990 | Alcock et al. | 72/19.2 |
| 5,538,092 | A * | 7/1996 | Precopia | 175/74 |
| 6,000,656 | A * | 12/1999 | Taylor et al. | 242/418.1 |
| 6,006,839 | A | 12/1999 | Dearing et al. | |
| 6,161,619 | A * | 12/2000 | Head | 166/355 |
| 6,276,456 | B1 * | 8/2001 | Head | 166/359 |
| 6,457,534 | B1 * | 10/2002 | Rolovic et al. | 166/381 |
| 6,516,892 | B2 * | 2/2003 | Reilly | 166/384 |
| 6,880,630 | B2 * | 4/2005 | Widney | 166/77.53 |
| 7,753,344 | B1 | 7/2010 | Moretz et al. | |
| 7,810,556 | B2 * | 10/2010 | Havinga | 166/77.3 |
| 8,613,309 | B1 * | 12/2013 | Bakker et al. | 166/77.1 |
| 8,689,862 | B2 * | 4/2014 | Talgo et al. | 166/77.1 |
| 2002/0195255 | A1 * | 12/2002 | Reilly | 166/384 |
| 2003/0010505 | A1 | 1/2003 | Gipson | |
| 2003/0034162 | A1 * | 2/2003 | Kulhanek | 166/384 |
| 2003/0044235 | A1 * | 3/2003 | Stockstill | 405/154.1 |
| 2004/0118556 | A1 | 6/2004 | Widney | |
| 2004/0188101 | A1 | 9/2004 | Moretz | |
| 2004/0194963 | A1 * | 10/2004 | Torres | 166/343 |
| 2010/0263879 | A1 * | 10/2010 | Cochran | 166/384 |
| 2011/0226885 | A1 * | 9/2011 | Fries et al. | 242/420 |
| 2011/0315804 | A1 * | 12/2011 | Talgo et al. | 242/362 |
| 2012/0111581 | A1 * | 5/2012 | He et al. | 166/384 |
| 2013/0094910 | A1 * | 4/2013 | Giles | 405/166 |
| 2013/0160988 | A1 * | 6/2013 | Armstrong et al. | 166/85.1 |
| 2013/0161441 | A1 * | 6/2013 | Bjornenak et al. | 242/484.2 |
| 2014/0014317 | A1 * | 1/2014 | Aarsland et al. | 166/77.2 |

FOREIGN PATENT DOCUMENTS

| | | | |
|---|---|---|---|
| EP | 0 571 207 | A1 | 5/1993 |
| FR | 2044130 | A5 | 2/1971 |
| FR | 2843954 | A1 | 3/2004 |
| FR | 2868408 | A1 | 10/2005 |
| GB | 1401422 | A | 7/1975 |
| GB | 2 296 001 | A | 6/1996 |
| GB | 2457585 | A | 8/2009 |
| JP | 57-141989 | U | 9/1982 |
| JP | 61-277561 | A | 12/1986 |
| RU | 2151264 | C1 | 6/2000 |
| WO | WO 0138768 | A1 * | 5/2001 |
| WO | WO 2006/027553 | A1 | 3/2006 |
| WO | WO 2010/117162 | A2 | 10/2010 |

* cited by examiner

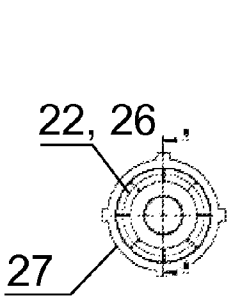
Fig. 5a(2)
Fig. 5a(1)
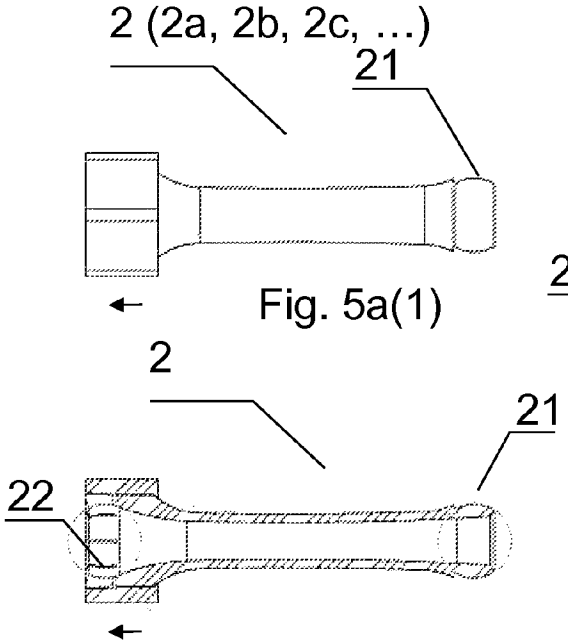
Fig. 5b
lock
Fig. 5c
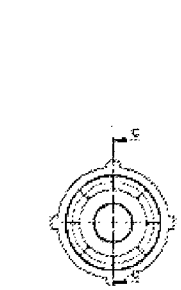
Fig. 5d(2)
Fig. 5d(1)
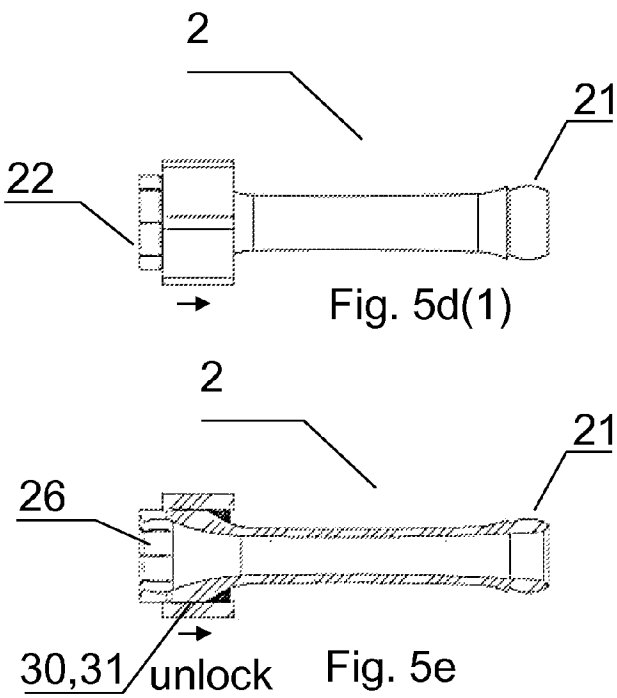
Fig. 5e
unlock
Fig. 5f

FLEXIBLE ROUTING DEVICE FOR WELL INTERVENTION

CROSS REFERENCE TO RELATED APPLICATIONS

This nonprovisional application claims the benefit of U.S. Provisional Application No. 61/580,098 filed on Dec. 23, 2011 and to Patent Application No. 20111775 filed in Norway, on Dec. 23, 2011. The entire contents of all of the above applications are hereby expressly incorporated by reference.

INTRODUCTION

The present invention relates to a conduit device for a petroleum well intervention string for guiding the intervention string, such as a carbon fibre reinforced rod containing electrical conductors and/or signal fibres, between a drum unit on deck and an intervention string injector on a wellhead.

PRIOR ART AND PROBLEMS RELATED THERETO

Traditionally wireline drum units are placed near the wellhead unit and aligned with the gooseneck on the wellhead unit and must have cleared a free straight path, also along the deck below, for the intervention string to hang in a catenary line between the drum and the gooseneck on the wellhead unit. Temporary differences in speed between the drum and the injector head are taken up in the slack catenary line. This slack line and the fixed spatial requirements excludes other operations in the area, and further poses a risk to personal injury and damage to the intervention string.

WO2011/096820 describes a series of ball-and-socket bending restrictor element pipe sections comprising pipe sections with ball-only ends for being linked using longitudinally split socket-only sleeves with locking elements. That bending restrictor is used over goosenecks.

BRIEF SUMMARY OF THE INVENTION

A solution to the above problem is a conduit device (7) for a petroleum well intervention string (0), comprising a first end (72) connected to an intervention string drum unit (100) with a drum (101), a second end (73) connected to an injector head (204) of a wellhead assembly (200), wherein said conduit device (7) at any point between said first end (72) and said second end (73) has a radius of curvature (R) larger than or equal to a given smallest allowable radius of curvature (R0) for said intervention string (0); said conduit device (7) forming a substantially incompressible fixed length path for the portion of said intervention string (0) at any time present between said first end (72) and said second end (73); said conduit device (7) constituting a tubular path for said intervention string (0).

Further advantageous features are defined in the dependent claims attached.

ADVANTAGES OF THE INVENTION

Advantages of the invention are mentioned under the heading "Embodiments of the invention" below.

FIGURE CAPTIONS

FIGS. 1*a* and 1*b* show a bend restrictor (1) of the invention bent into an arch, a semi-circle with a minimum allowed bending radius of R0 shown in side view and in end view of the arch. The pipe sections (2) are generally rotational symmetric about their local longitudinal axis and are provided with ball-and-socket connectors so the bend restrictor arch is not limited to any fixed plane.

FIG. 2 is a perspective (isometric) illustration of an intervention drum unit (100) which may be used with the invention. The drum unit (100) comprises an intervention string drum (101) arranged laterally translatable within a steel frame (102) and provided with a string tension compensator (103) arranged for taking up temporary differences between the injector head (204) and the drum (101) now as the length of the intervention string (0) part residing between the entry point (105) of the frame (102) and the injector head (204) is constant. Part of the conduit device (7) of the invention is seen attached to the entry point (105).

FIG. 3 is a section view of a bend restrictor of the invention comprising a series of generally identical pipe sections with a ball-and socket type connectors, the ball at a first end and the spherical zone socket at the opposite end. In the embodiment illustrated there is inserted a low friction polymer tube through the bend restrictor so as for guiding the intervention string and reducing friction and wear.

FIG. 4 is a side view of the same.

FIGS. 5*a*(1) to 5*f* are illustrations of a single pipe section (2) (2*a*, 2*b*, 2*c* . . . ) forming elements from which the bend restrictor of the invention is assembled.

FIG. 5*a*(1) is a side view of a single pipe section of the invention, the left part showing a locking ring at the receptacle or socket end, and the right part showing a corresponding ball-part end for being inserted into a socket end of a next pipe section. FIG. 5*a*(2) is an end view of the locking ring and the socket end.

FIG. 5*b* is a section view of the same, showing the locking ring in the locking position about the socket end. A sphere of the internal radius of the socket end is shown, please see FIG. 7 for principal details.

FIG. 5*c* is an isometric "perspective" view of the same pipe section of the invention.

FIGS. 5*d*(1), 5*d*(2) 5*e*, 5*f* correspond to FIGS. 5*a*(1), 5*a*(2) 5*b*, and 5*c*, with the difference of the locking ring being moved to the unlock position which allows the resilient segment sectors (26) of the socket to flex outward and release the ball part (21)

FIG. 6*a* is a perspective illustration of a wellhead with an injector head in a steel frame, the conduit device (7) here constituted by a flexible bend restrictor (1) laid over a gooseneck attached to the steel frame, the bend restrictor (1) forming a closed, fixed length path between the injector head (204) and the steel frame (102) of the motorized drum unit (100) with a large-diameter drum (101) and a tension compensator arch (103). The push-through threading direction for the intervention string for the particular unidirectional bending restrictor type illustrated in FIGS. 1*a*, 1*b* and 5*a*(1)-f is illustrated by a broken line arrow.

FIG. 6*b* is a side elevation view of the same, and FIG. 6*c* is a top view of the same.

FIG. 7 is a principle illustration of a spherical segment: a solid defined by cutting a sphere with a pair of parallel planes. The surface of the spherical segment is called the spherical zone, excluding the planar bases. In the present invention the spherical zone is specified to have the two parallel planes arranged at either sides of the sphere's centre (c). This limitation is simply to arrange the spherical zone of the ball connector (21) to be retained within the similarly shaped corresponding spherical zone of socket connector (22) of substantially the same radius, of which the inner surface is illustrated with an exaggerated radius.

EMBODIMENTS OF THE INVENTION

Figure 8:
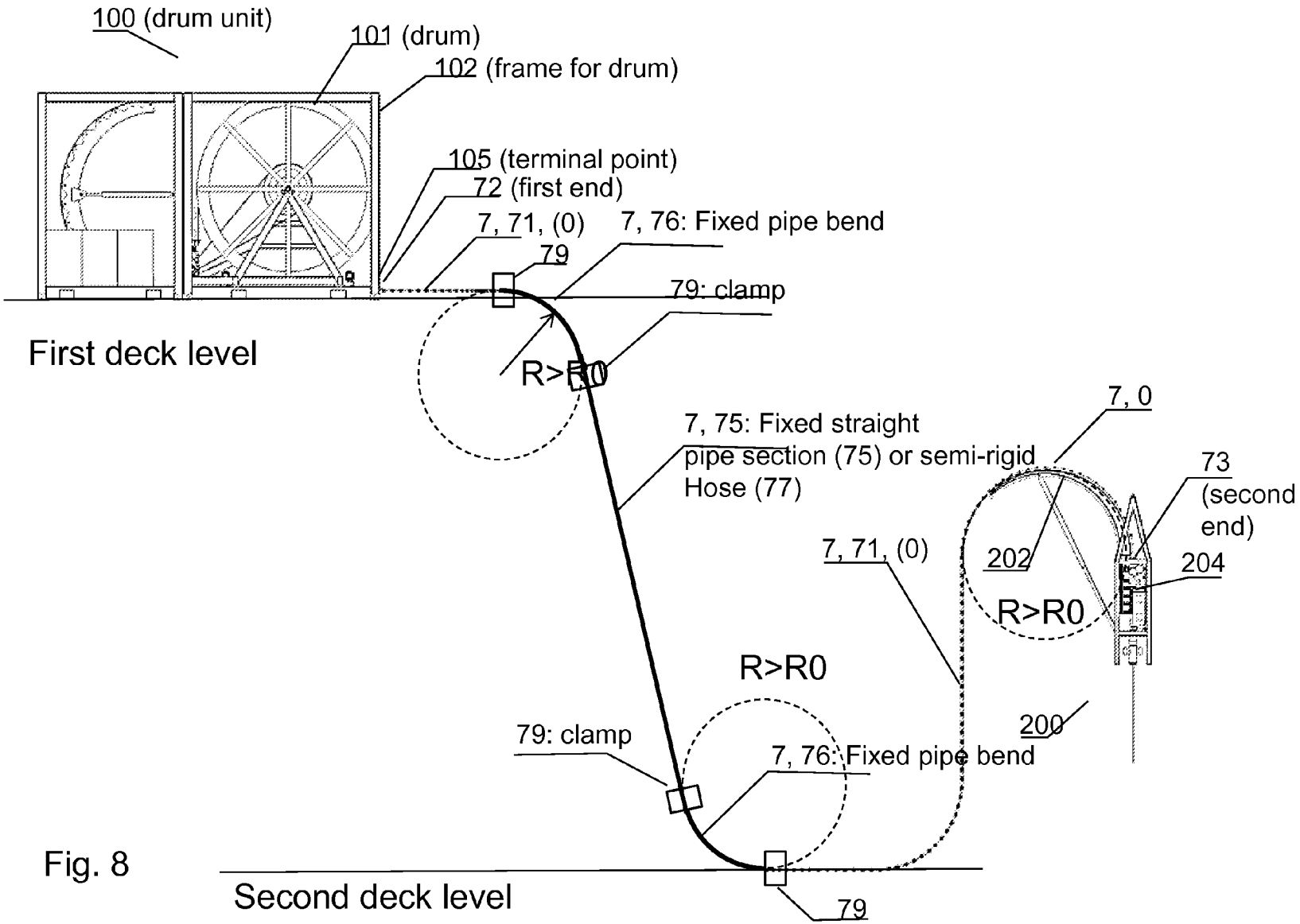
FIG. 8 is an example illustration of the present invention wherein the drum unit is arranged at a first deck level of a petroleum platform and the conduit device is led via a second deck level to a wellhead unit (200).

The present invention is a conduit device (7) for a petroleum well intervention string (0). The conduit device comprises a first end (72) arranged for being connected to an intervention string drum unit (100) with a drum (101), and a second end (73) connected to an injector head (204) of a wellhead assembly (200). Please see FIG. 6*a* for a general setup of the invention. The conduit device (7) of the invention, at any point between said first end (72) and said second end (73), has a radius of curvature (R) larger than or equal to a given smallest allowable radius of curvature (R0) for said intervention string (0). Further, the conduit device (7) of the invention forms a substantially incompressible fixed length path for the portion of said intervention string (0) at any time present between said first end (72) and said second end (73). Further, the conduit device (7) of the invention constitutes a tubular path for the intervention string (0). In this context, any straight pipe will satisfy, and any pipe bend or bending restrictor used, must satisfy the requirement "having a radius of curvature (R) larger than the smallest allowable radius of curvature (R0). Please see FIG. 8 showing places where the radius of curvature satisfies this requirement.

The term "tubular" used here means pipe-shaped, pipe bend, hose-shaped, tunnel or hole, i.e. any closed channel adapted for and wherein the intervention string runs. The notion "incompressible" is exemplified by such as a metal pipe, fibre reinforced tubes, a chain of ball-and-socket type bending restrictor elements made in metal or a hardened polymer material, please see an example in FIGS. 1*a*, 1*b*, 3, 4, and 5*a*(1)-f.

An advantage of the present invention is that the conduit device (7) is incompressible results in that the intervention string tension is substantially maintained (except for friction loss) at all times along all the path between the injector head (204) and the drum unit (100).

An advantage by the invention by the feature that the conduit device (7) being tubular prevents mechanical contact between the string (0) and anything external to the conduit device (7) and also protects the string (0) from wear and crushing damage. This feature further protects personnel's health by preventing personal injury by mechanical contact with the running intervention string (0) or chemical contact with the possibly polluted intervention string (0).

In an embodiment of the invention it comprises one or more sections of straight pipe (75) of extensive length. An example is illustrated in FIG. 8 wherein the drum unit is placed at a first deck level of a petroleum rig or vessel, and the conduit device with the intervention string running within is extended via a second deck level through bends and a fixed straight pipe section to a flexible bend restrictor to a gooseneck (202) on an injector head (204) at a wellhead assembly (200). Beyond the wellhead assembly the intervention string extends according to desire into the well.

In an embodiment of the invention, at any point between said first end (72) and said second end (73) has a radius of curvature (R) larger than or equal to a given smallest allowable radius of curvature (R0) for said intervention string (0). This is in practice not optional but is a requirement regardless of how the conduit is made. It limits the amount of bending that the member can be subjected to. Elements are specified below, but include straight pipes, bends, stiff hoses, bend restrictor elements.

In an embodiment of the invention, the conduit device (7) comprises one or more pipe bend (76) of fixed curvature.

Figure 1B:
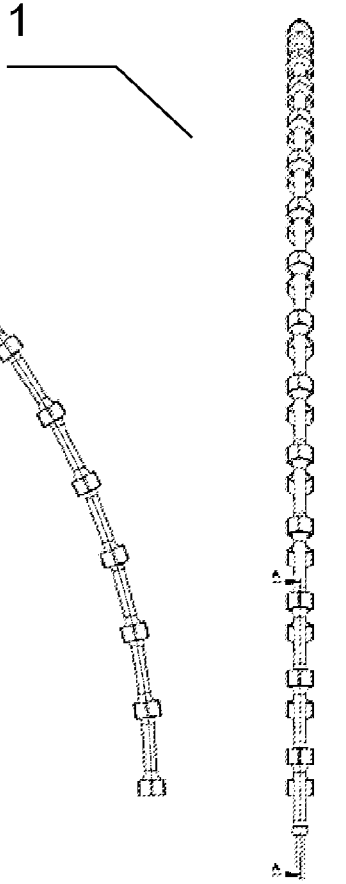
Figure 1A:
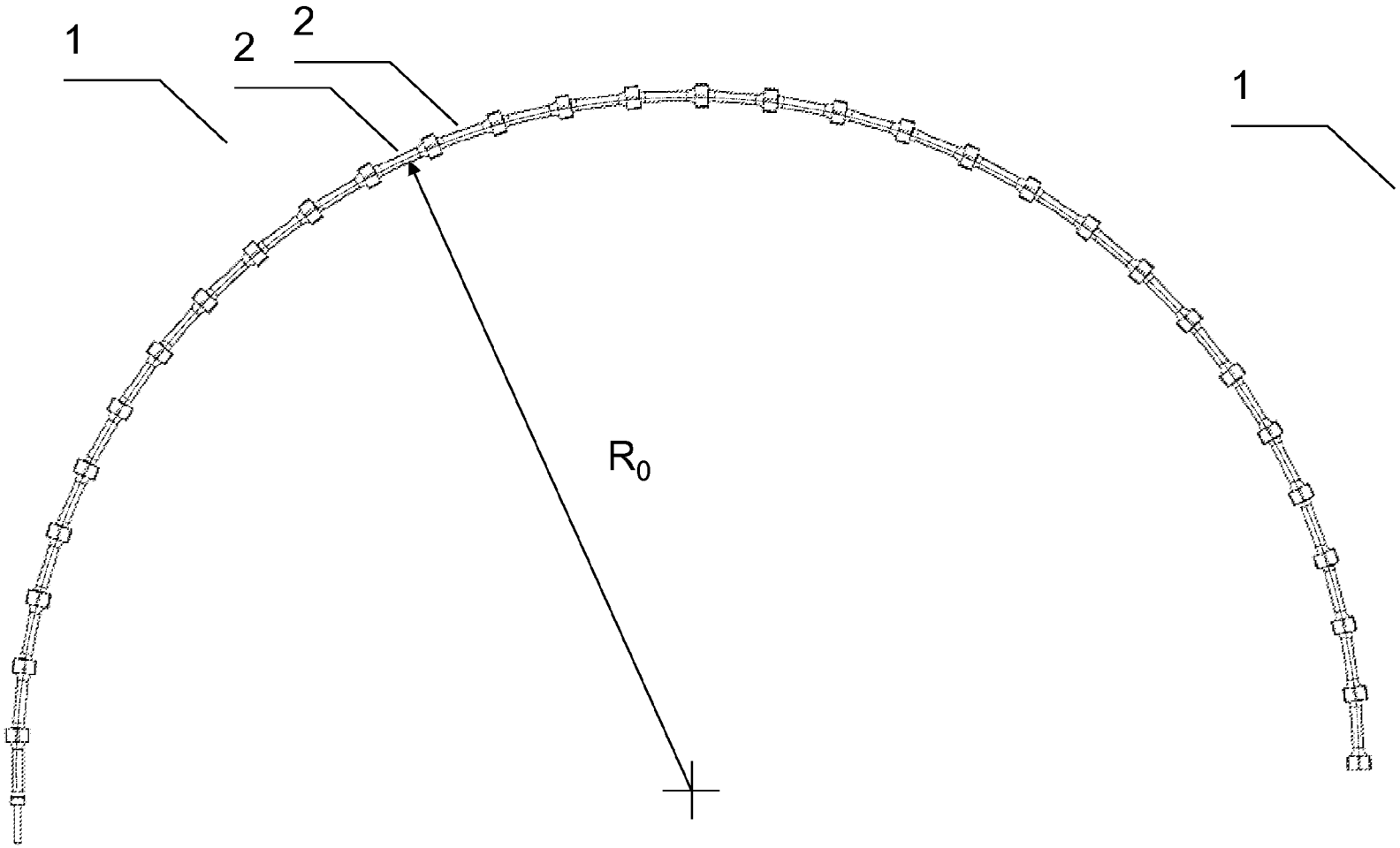
Figure 2:
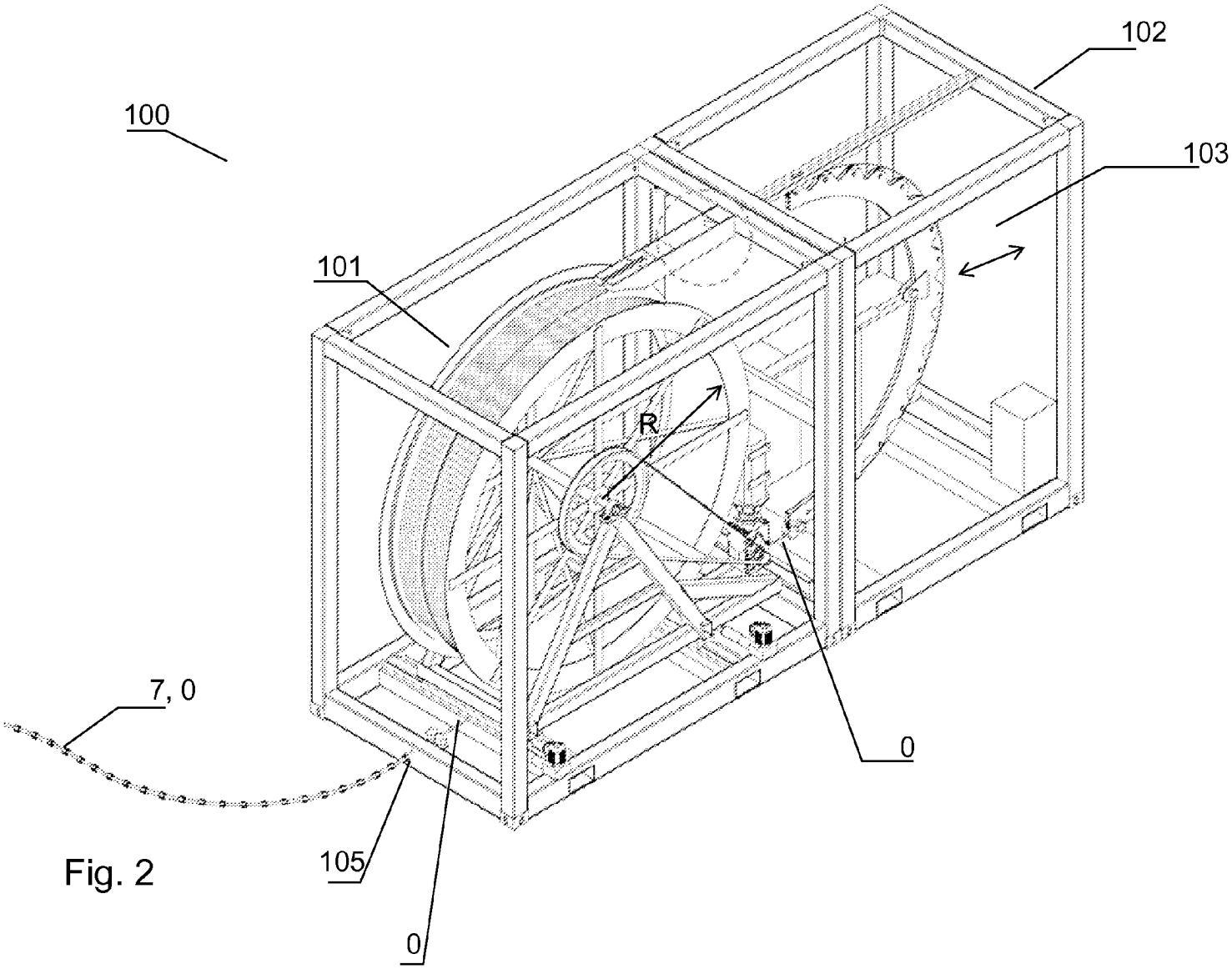
Figure 4:
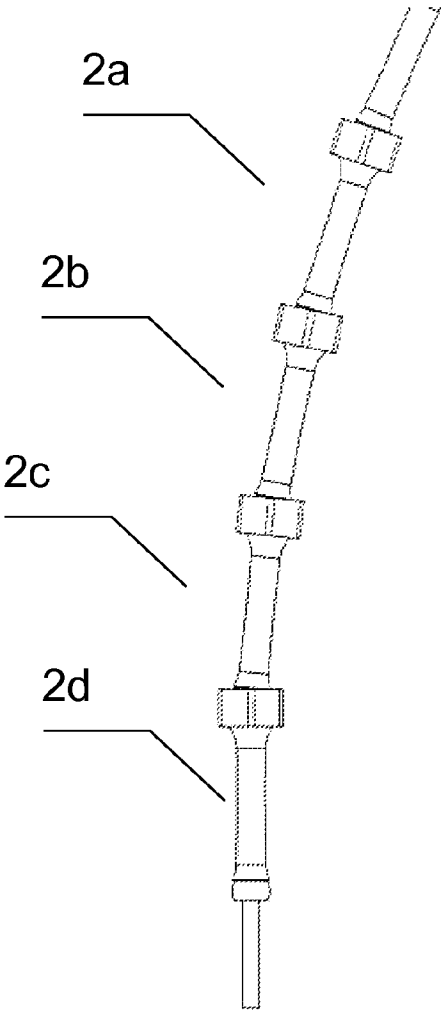
Figure 3:
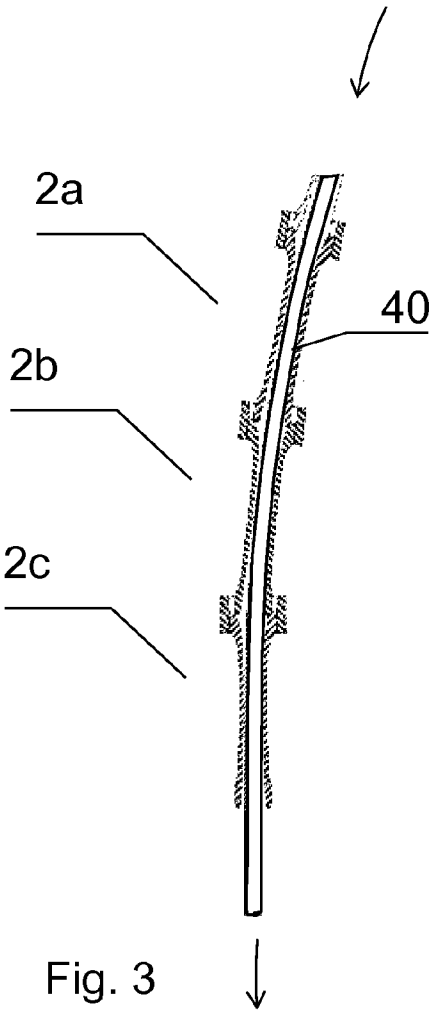
Figure 6A:
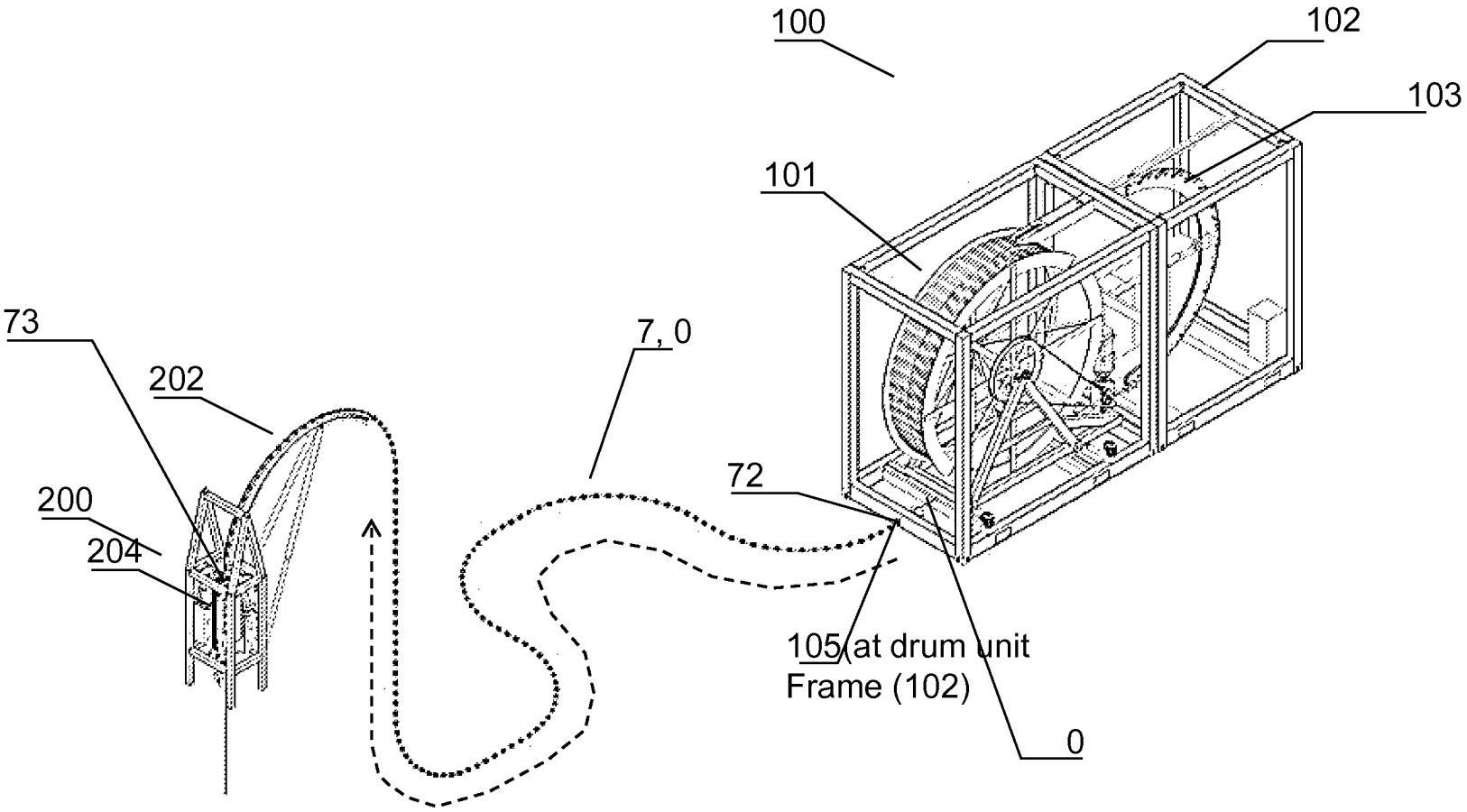
Figures 6B, 6C:
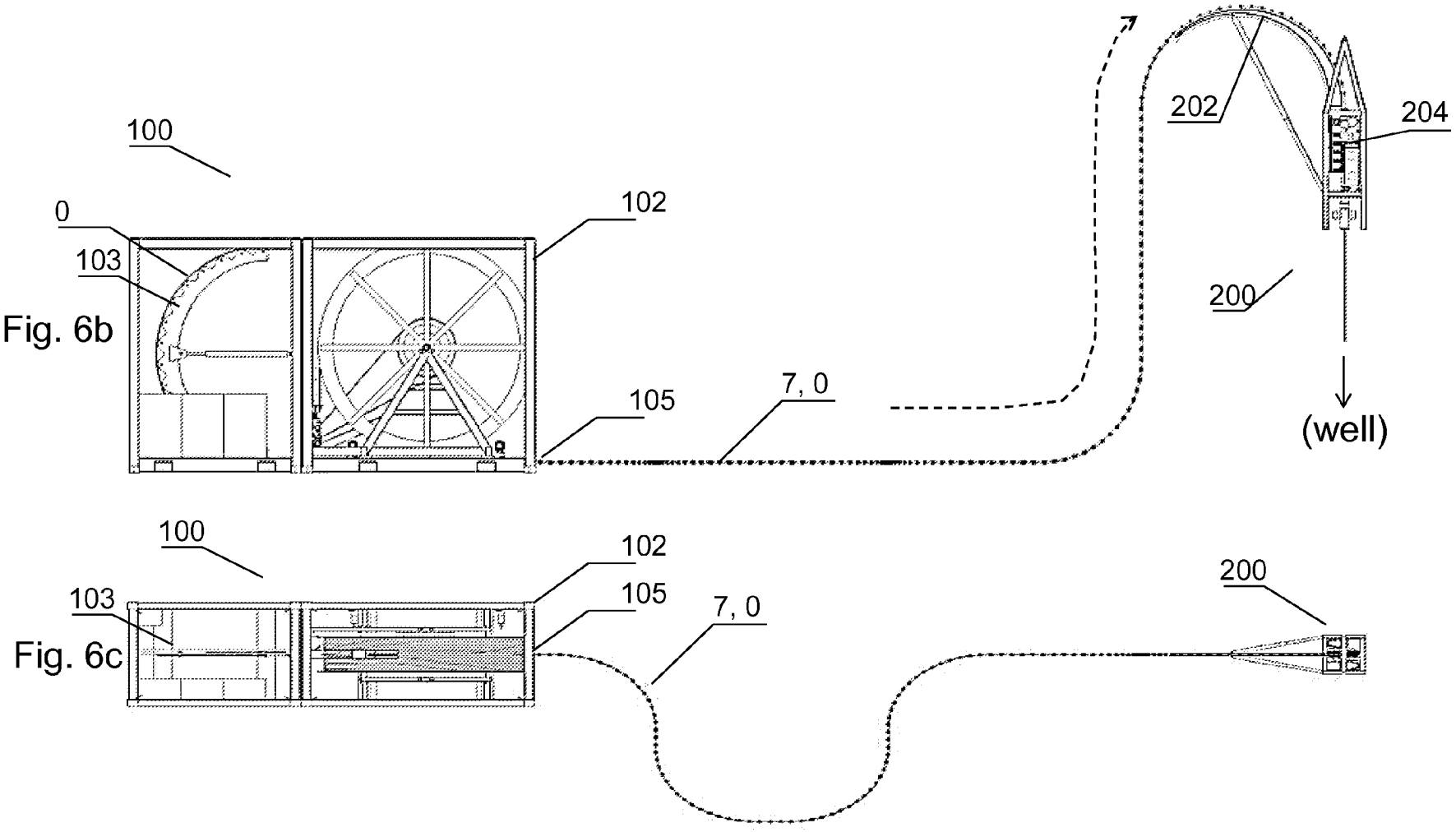
Figure 7:
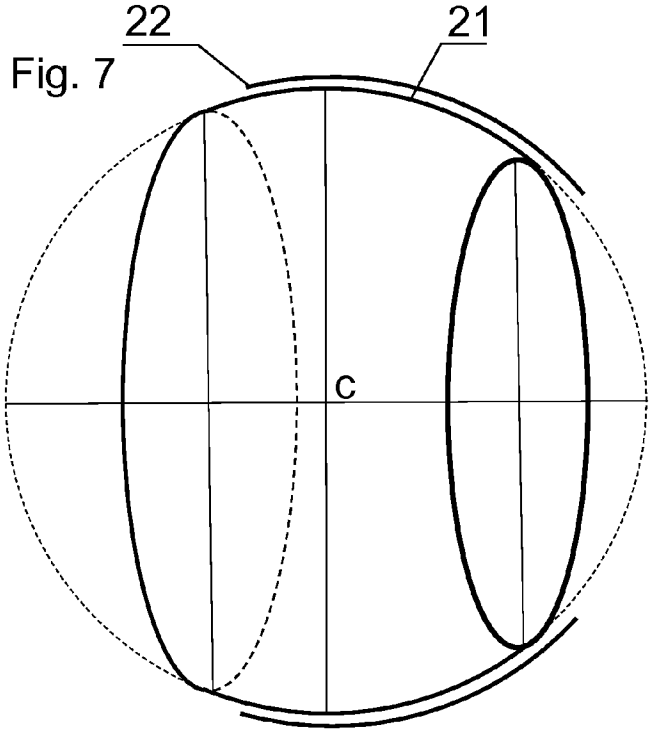
Figure 9:
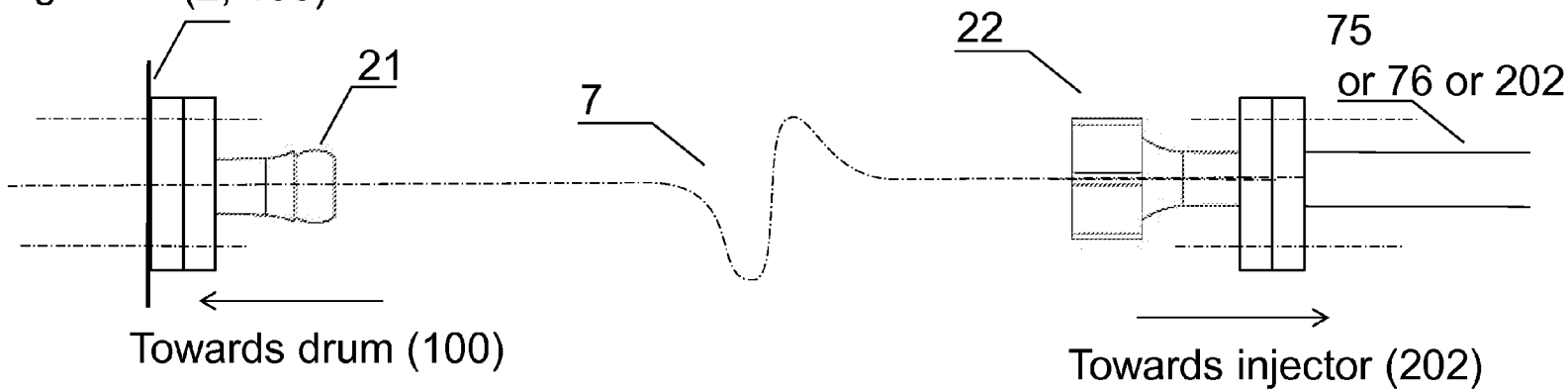
FIG. 9 is an illustration of a termination connector unit with a ball type joint and a flange heading towards the drum's end, here the entry point (105) at the drum frame (102), and a spherical socket-type connector with a flange for being connected towards the injector head's end. Flange connections may be replaced by weld joints, threaded joints, according to the designer's desire.

In an embodiment of the invention the conduit device (7) of the invention is laterally flexible along at least a portion of its path between the first end (72) and the second end (73). Examples of this is shown in FIGS. 6*a*, 6*b*, and 6*c*, and in FIG. 8 for the section between a terminal point (105) on the drum frame (102) and the clamp (79) for the fixed pipe bend, and between the fixed pipe bend near the second deck level at the clamp (79) where the bend restrictor is allowed to flex laterally (but not longitudinally) until it runs over the gooseneck (202).

An advantage of the present invention is that one may place the intervention drum at a significant distance from the wellhead unit, more than 80 meters in total distance as counted along the conduit device has been tested, and the requirement of alignment and a free straight path for the intervention string hanging in a catenary line between the drum and the wellhead unit may be disposed with.

The conduit device (7) comprises in an embodiment of the invention one or more ball-and-socket type bend restrictor elements (2), please see FIGS. 1*a*, 1*b*, 2, 3, 4, 5*a*(1)-f, 6*a*, 6*b*, 6*c*, 7, 8, 9, forming flexible bend restrictor sections along the path between said first end (72) and said second end (73). These ball-and socket connections may be comprised in a series of non-fixed bend restrictor pipes (2), so-called "knuckle jointed" pipe connections, which allows to flex the path according to space requirements, and to move part of the conduit device if refurnishing of other equipment along the path on the petroleum rig is required.

In an embodiment of the invention the conduit device (7) comprises one or more extensive sections of semi-stiff hose (77). Practical tests of more than 30 meters of stiff hose has been tried with success.

The conduit device (7) of the invention may have the first end (72) attached at a terminal point (105) of a drum frame (102) of said drum unit (100). Preferably and advantageously, said drum frame (102) is provided with a tension compensator arch (103) arranged between said terminal point (105) and said drum (101). Advantageously, any temporary speed differences due to different inertia of the string (0), the injector head (204) and the drum (101) are taken up by the tension compensator arch (103).

Preferably also, the conduit device of the invention not only forms an incompressible length path, but also forms a substantially inextendable fixed length path for said portion of said intervention string running or residing between said first end (72) and said second end (73), i.e. that all the tubular components may not be extended nor pulled apart in their longitudinal direction. This is achieved by the lockable but rotatable ball- and socket connectors illustrated in FIGS. 5*a*(1)-5*f* and the corresponding end pieces with a flange and a ball connector or a socket connector. Pipes may also have ordinary flange or screw connections. An advantage of this feature is that the conduit device (7) is not torn apart by an incompressible, semi-rigid composite rod or tubing intervention string (0) which is subject to compressive forces either due to being pushed through the conduit device (7) or due to temporary speed differences between the injector head (204) and the drum (100).

In an embodiment of the invention the conduit device is laid over or attached to a gooseneck (202) arranged at said second end (73) at the wellhead.

The conduit device of may comprise a combination of components. It may comprise flange connections (78) with either a ball connector (21) or a socket type connector (22) in the opposite end. The flange connections may be used as end or intermittent connections so as for allowing connection of any of: the drum frame (102), the bend restrictor element pipes (2), the pipe bends (76), the straight pipe sections (75), possible semi-stiff hoses (77), and an entry point of said injector head (204).

The invention claimed is:

1. A flexible routing system for a petroleum well intervention string, comprising:

a conduit device comprising a first end and a second end;

an intervention string drum unit comprising a drum, a drum frame and a tension compensator arch, wherein the first end of the conduit device is connected to the intervention string drum unit and arranged at a terminal point of the drum frame of the intervention string drum unit, and the second end of the conduit device is connected to an injector head of a wellhead assembly, wherein said conduit device at any point between said first end and said second end has a radius of curvature larger than or equal to a given smallest allowable radius of curvature for said petroleum well intervention string, and forms a substantially incompressible fixed length path for a portion of said petroleum well intervention string at any time present between said first end and said second end, said conduit device constituting a tubular path for said petroleum well intervention string, and wherein the petroleum well intervention string extends along a running path from the drum to the terminal point of the drum frame, and the tension compensator arch is arranged along the running path of the petroleum well intervention string at a point between the terminal point of the drum frame and the drum.

2. The flexible routing system of claim 1, wherein the conduit device further comprises one or more sections of straight pipe of extensive length.

3. The flexible routing system of claim 2, wherein the conduit device further comprises one or more pipe bend of fixed curvature.

4. The flexible routing system of claim 2, wherein said conduit device is laterally flexible along at least a portion of a path of the conduit device between said first end and said second end.

5. The flexible routing system of claim 2, wherein the conduit device further comprises one or more ball-and-socket type bend restrictor elements forming flexible bend restrictor sections along the path between said first end and said second end.

6. The flexible routing system of claim 1, wherein the conduit device further comprises one or more pipe bend of fixed curvature.

7. The flexible routing system of claim 6, wherein said conduit device is laterally flexible along at least a portion of a path of the conduit device between said first end and said second end.

8. The flexible routing system of claim 1, wherein said conduit device is laterally flexible along at least a portion of a path of the conduit device between said first end and said second end.

9. The flexible routing system of claim 1, wherein the conduit device further comprises one or more ball-and-socket type bend restrictor elements forming flexible bend restrictor sections along the path between said first end and said second end.

10. The flexible routing system of claim 1, wherein the conduit device further comprises one or more sections of semi-stiff hose.

11. The flexible routing system of claim 1, wherein said conduit device forms a substantially inextendable fixed length path for said portion of said intervention string running or residing between said first end and said second end.

12. The flexible routing system of claim 1, wherein said second end of the conduit device is arranged at a gooseneck of the injector head of the wellhead assembly.

13. The flexible routing system of claim 1, wherein the conduit device further comprising bend restrictor element pipes, pipe bends, straight pipe sections, semi-stiff hoses, and said conduit device further comprises flange connections with either a ball connector or a socket type connector so as for allowing connection of any of:

said drum frame, said bend restrictor element pipes, said pipe bends, said straight pipe sections, said semi-stiff hoses, and an entry point of said injector head.

14. The flexible routing system of claim 1, wherein the conduit device further comprises low friction polymer tube through the conduit device so as for guiding the intervention string and reducing friction and wear.

* * * * *